US009214731B2

(12) United States Patent
Grange et al.

(10) Patent No.: US 9,214,731 B2
(45) Date of Patent: Dec. 15, 2015

(54) PLANAR ANTENNA HAVING A WIDENED BANDWIDTH

(75) Inventors: François Grange, Moirans (FR); Christophe Delaveaud, St. Jean de Moirans (FR); Bernard Viala, Sassenage (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 406 days.

(21) Appl. No.: 13/988,750

(22) PCT Filed: Nov. 22, 2011

(86) PCT No.: PCT/EP2011/070712

§ 371 (c)(1),
(2), (4) Date: Jul. 23, 2013

(87) PCT Pub. No.: WO2012/069492

PCT Pub. Date: May 31, 2012

(65) Prior Publication Data

US 2014/0043199 A1 Feb. 13, 2014

(30) Foreign Application Priority Data

Nov. 22, 2010 (FR) ..... 10 59611

(51) Int. Cl.
*H01Q 9/04* (2006.01)
*H01Q 1/38* (2006.01)

(52) U.S. Cl.
CPC ..... *H01Q 9/0407* (2013.01); *H01Q 9/0428* (2013.01); *H01Q 9/0457* (2013.01)

(58) Field of Classification Search
CPC ..... H01Q 1/38; H01Q 9/04
USPC ..... 343/843, 700 MS, 905
See application file for complete search history.

(56) References Cited

U.S. PATENT DOCUMENTS

| | | | | |
|---|---|---|---|---|
| 4,903,033 | A | 2/1990 | Tsao et al. | |
| 7,471,248 | B2 * | 12/2008 | Popugaev et al. | H01Q 9/0414 343/700 MS |
| 7,589,676 | B2 | 9/2009 | Popugaev et al. | |
| 7,973,733 | B2 * | 7/2011 | Mohammadian | H01Q 1/38 343/700 MS |
| 8,723,748 | B2 * | 5/2014 | Svensson | H01Q 9/16 343/700 MS |
| 8,773,312 | B1 * | 7/2014 | Diaz | H01Q 1/38 343/700 MS |
| 2004/0027292 | A1 * | 2/2004 | Gabriel et al. | H01Q 9/0414 343/700 MS |
| 2004/0239567 | A1 * | 12/2004 | Van Der Poel | H01Q 9/0414 343/700 MS |
| 2009/0174606 | A1 | 7/2009 | Qian et al. | |
| 2010/0151797 | A1 | 6/2010 | Viala et al. | |

FOREIGN PATENT DOCUMENTS

EP 2200051 A1 6/2010

OTHER PUBLICATIONS

Jaume Anguera, et al., "Stacked H-Shaped Microstrip Patch Antenna", IEEE Transactions on Antennas and Propagation, Apr. 2004, pp. 983-993, vol. 52, No. 4, IEEE.

* cited by examiner

*Primary Examiner* — Huedung Mancuso
(74) *Attorney, Agent, or Firm* — Baker & Hostetler LLP

(57) ABSTRACT

A planar antenna with widened bandwidth comprises at least one first conducting element disposed above an earth plane and separated from the latter, and means for exciting said at least first conducting element, configured to excite two distinct orthogonal resonant modes, wherein said at least first conducting element is embodied by a substrate comprising at least one thin layer of an anisotropic material with relative permeability of greater than 10 for 2 GHz. The antenna applies notably to mobile communications terminals.

13 Claims, 10 Drawing Sheets

PLANAR ANTENNA HAVING A WIDENED BANDWIDTH

CROSS-REFERENCE TO RELATED APPLICATIONS

This application is a National Stage of International patent application PCT/EP2011/070712, filed on Nov. 22, 2011, which claims priority to foreign French patent application No. FR 1059611, filed on Nov. 22, 2010, the disclosures of which are incorporated by reference in their entirety.

FIELD OF THE INVENTION

The present invention relates to a planar antenna with widened bandwidth. It applies notably to mobile communications terminals.

The invention applies, for example, in respect of microwave planar antennas with widened bandwidth.

BACKGROUND

Numerous appliances, notably portable telephones, use an antenna employing planar microstrip technology for their flexible and easily integratable structure.

However, this antenna must meet certain criteria such as have a wide bandwidth, large gain, reduced proportions and be low cost in order to integrate it into these appliances. These criteria often cannot be complied with at the same time, notably in respect of bandwidth, good efficiency (large gain) and reduced proportions. In particular, to have good efficiency, the bandwidth of this antenna is generally low, of the order of 5%.

Several techniques based on modifying the geometry of the antenna have been proposed for widening the bandwidth to the detriment of the proportions of the antenna. Other techniques rely on the use of lossy dielectric substrates, the insertion of slots on the radiating element, the use of the near context, and the use of materials having high-impedance surfaces.

An example of such an antenna is given by the article "Stacked H-shaped microstrip patch antenna", published in 2004 in Antennas and Propagation, IEEE Transactions, pages 983 to 993, by J. Anguera et al.

In this article is described a patch antenna, comprising a first radiating element disposed above an earth plane and excited in its fundamental mode by a coaxial probe, and a second radiating element disposed above the first element and excited by the first radiating element by capacitive coupling so that the currents develop in the first radiating element and in their turn excite the second element. Metallic pads allow the connection between the various layers separated from one another by an air layer acting as dielectric so as to electrically insulate the conducting layers from one another.

In this article, the two radiating elements do not have the same size, the second radiating element is larger than the first radiating element. This results in a creation of two separate frequency bands.

The bandwidth of such an antenna is increased with respect to a conventional structure but to the detriment of the size of this antenna which is bulky. It follows from this that antennas of this type are very difficult to integrate since a thickness of the antenna is obtained that is relatively large for the needs of integration into a communicating object.

SUMMARY OF THE INVENTION

One of the aims of the invention is to alleviate all or some of the drawbacks of the antennas of the prior art by proposing an antenna which exhibits at one and the same time a widened bandwidth and lesser proportions with respect to the known antennas of the prior art.

An object of the invention is to propose an antenna which has good efficiency, stated otherwise improved effectiveness of radiation.

Another object of the invention is to propose an antenna made of thin layers in planar technology also reducing its proportions so as to be able to integrate it into an array of antennas or any communication system.

Another object of the invention is to propose a dual-mode antenna, stated otherwise two modes of polarization of the electromagnetic field propagating in the antenna, with two close resonant frequencies obtained by virtue of a simple power feed/excitation device.

Another object of the invention is to propose an antenna with the two mutually orthogonal modes of polarization, the resulting orientation of whose electromagnetic field evolves as a function of frequency.

Another object of the invention is to propose an antenna having an input impedance compatible with correct matching to microwave devices.

Another object of the invention is to propose a low-cost simple-to-make antenna favorable to industrial mass production.

For this purpose, the subject of the invention is a planar antenna suitable for transmitting or receiving an electromagnetic wave, the antenna comprising at least one first conducting element disposed above an earth plane and separated from the latter, means for exciting said at least first conducting element configured to excite two distinct orthogonal modes of propagation (in particular two resonant modes), characterized in that said at least first conducting element is embodied by a substrate comprising at least one thin layer of an anisotropic material with relative permeability of greater than 10 for 2 GHz.

According to one embodiment of the antenna according to the invention, at least one slot formed in the earth plane and allowing said at least one first conducting element to be fed by electromagnetic coupling by at least one transmission line, characterized in that said at least one slot is embodied by a first opening extending in a direction forming a first angle of between 30° and 60° with the direction of the transmission line, and by a second opening extending in a direction forming a second angle of between −30° and +30° with the direction of the first opening.

An advantage of an antenna according to the invention resides in the fact that by virtue of the presence of a thin-layer anisotropic material and/or the disposition of the openings with respect to an edge of the conducting or radiating element and their mutual disposition, the electromagnetic field in the antenna is forced to propagate according to two, distinct and close, mutually orthogonal modes of propagation, leading the antenna to have just a single band that is more widened with respect to the bandwidth of known antennas, without complicating the structure and the proportions of the antenna. A dual-mode antenna is thus created.

The embodiments of this planar antenna can comprise one or more of the following characteristics:

- each opening comprises a point proximal to a corner of said at least one first conducting element situated at a maximum distance from said corner which is substantially equal to a third of the length of the electromagnetic wave, advantageously substantially equal to a quarter of this length;

the proximal point is situated substantially on the diagonal linking said corner to the opposite corner of said at least one first conducting element;

said at least one transmission line crosses each opening with an angle of between 30° and 150° with the direction in which the opening extends;

said at least one first conducting element exhibits different dimensions in two orthogonal directions (X, Y);

said at least first conducting element is embodied by a substrate comprising at least one thin layer of an anisotropic material with relative permeability of greater than 10 for 2 GHz;

the substrate can furthermore comprise at least one thin layer of a dielectric material with relative permittivity of greater than 10 for 2 GHz;

the substrate can comprise a stack of at least one thin layer made of anisotropic material alternating with at least one thin layer made of dielectric material, the thickness of the thin layer being between $\lambda/500$ and $\lambda/300$;

said at least first conducting element exhibits equal dimensions in two orthogonal directions X, Y, advantageously equal to half the length of the electromagnetic wave;

the antenna can comprise at least one second conducting element situated above said at least first conducting element and separated from the latter by an intermediate layer;

said at least one first conducting element and said at least one second conducting element have the same dimensions;

the openings are brought together to form just a single slot, and said at least one transmission line is disposed facing this slot so as to produce an electromagnetic coupling, through the first opening and through the second opening, with said at least one first and one second conducting elements;

said single slot forms an "L" and the transmission line is disposed facing the corner of said "L" so as to form, in the plane of said at least conducting elements, an angle of between 30° and 60° with each of the two axes of the "L", advantageously an angle of 45°.

These embodiments furthermore exhibit the following advantages:

the use of the two openings at positions situated at a third, or indeed at a quarter of the length of the electromagnetic wave emitted or received, or the use of the "L"-shaped slot in alignment with a corner of one of the conducting or radiating elements, makes it possible to excite two modes of propagation of the electromagnetic field of the antenna;

the use, for one of the conducting elements, of a multi-alternating anisotropic magneto-dielectric composite substrate with adjustable relative permeability and relative permittivity, in particular greater than 10 for 2 GHz, makes it possible to increase the bandwidth of the planar antenna while contributing to its miniaturization;

the use of an "L"-shaped slot in alignment with a corner of one of the conducting elements constitutes a simple-to-make power feed/excitation device and makes it possible to have just a single inlet to excite the two orthogonal modes of propagation of the electromagnetic field in the antenna in order to maintain a desired type of polarization;

electrically insulating the radiating or conducting elements from the earth plane makes it possible to avoid making vertical pads linking these elements to the earth plane, thereby simplifying the fabrication of the planar antenna and also contributing to the miniaturization of the antenna;

rotating the polarization of the electromagnetic field as a function of frequency by an angle that can range from 0° to 90°.

BRIEF DESCRIPTION OF THE DRAWINGS

Other characteristics will become apparent on reading the nonlimiting detailed description given by way of example which follows in conjunction with appended drawings which represent.

DETAILED DESCRIPTION

For convenience of representation, the figures are not to scale notably as regards the thicknesses as well as the sizes of the openings.

In this description, the figures are oriented with respect to an XYZ reference frame comprising two orthogonal horizontal directions X and Y and a vertical direction Y. The terms "up"/"down", "above"/"below", "on"/"under" are defined with respect to this direction Z.

In the subsequent description, the characteristics and functions well known to the person skilled in the art are not described in detail.

Figure 1:
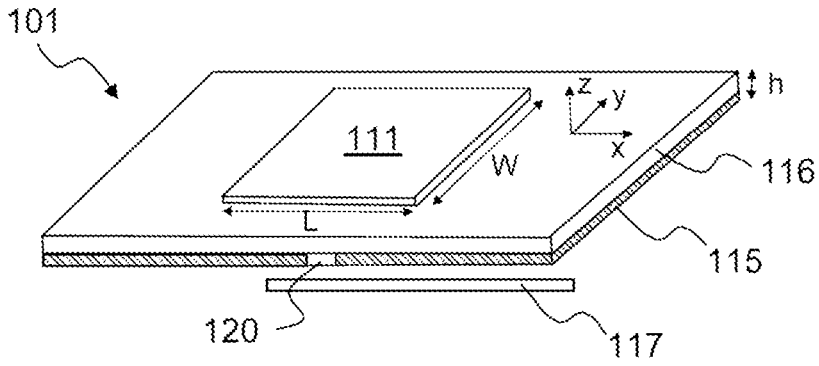
FIG. 1, a perspective representation of a first embodiment of an antenna according to the invention.

In FIG. 1, a first embodiment of an antenna according to the present invention is represented according to a perspective view.

The antenna 101 of the invention is a microstrip planar antenna, able to emit and/or to receive electromagnetic waves at a working frequency $f_T$ corresponding to a wavelength $\lambda_T$. Typically, the frequency $f_T$ lies between 100 MHz and 100 GHz and, preferably, between 1 GHz and 10 GHz.

The planar antenna 101, preferably in microstrip technology, essentially emits electromagnetic waves in the half-space above the plane XY. Here, the main direction of emission/reception is perpendicular to the plane XY and coincident with the Z direction.

Here, the antenna 101 comprises a stack, in the Z direction, of various layers extending essentially in a horizontal plane.

The stack comprises a first conducting or radiating element 111 disposed above an earth plane 115, or a substrate having an earthing function. In the particular case described here, the first conducting element takes the form of a horizontal plate, preferably substantially rectangular or substantially square, but can have other geometries as will be seen further on.

In this embodiment, the first conducting element 111 exhibits a horizontal front face exposed to the electromagnetic radiations.

To electrically insulate the first conducting element 111 and the earth plane 115, these last two are separated by a dielectric layer or a substrate 116 of a height h corresponding to the thickness of this layer which is for example of the order of 500 to 700 μm.

In the example the substrate 116 can be a dielectric thin layer of ROGERS type marketed under the brand ROGERS 4003 with relative permittivity equal to 3.55 and thickness equal to 0.8 mm. The earth plane 115 can be made of copper and can have a thickness of several micrometers, for example, of 9 μm to several mm.

A microstrip transmission line is placed below the earth plane 115 to feed the first conducting or radiating element 111 through a slot 120 made in the earth plane 115.

Here, the transmission line can be a microstrip line printed on a substrate of the ROGERS 4003 type and with characteristic impedance equal to 50 ohms. The dimensions of this line can be determined on the basis of the thickness and the permittivity of the substrate, for example, they can be 1.2 mm in width and 6 cm in length.

A substrate forming layer, not represented, can be envisaged between the earth plane 115 and the transmission line 117 to maintain it below this plane and to insulate it electrically from the latter.

The earth plane 115 insulates the transmission line 117 from the radiating element 111 and limits the interference of the parasitic radiation on the radiation pattern of the antenna, thus offering purity of polarization.

In a known manner, the transmission line, the electrical parameters and the dimensions of the various layers making up the antenna as well as the size of the slot are used to optimize the antenna.

According to the invention, the position of the slot 120 with respect to the conducting element as well as its shape have an impact on the performance of the antenna, in particular its bandwidth, as will be seen further on.

According to the first embodiment of the invention, the first conducting or radiating element 111 is embodied by a thin-layer anisotropic magneto-dielectric composite substrate with adjustable permeability and adjustable permittivity.

The material disclosed in the European patent application published under the number EP2200051 can, for example, be used within the framework of the present invention to modify the conditions of resonance of the conducting element 111.

More particularly, the first conducting element is embodied by at least one layer of ferromagnetic material whose relative permeability is greater than 10 in the frequency band of interest, for example, for a frequency of 2 GHz, and whose thickness is strictly less than the skin thickness of this ferromagnetic material. This thickness can be of the order of 25 to 80 nm.

A dielectric layer can be envisaged between this layer of ferromagnetic material and the earth plane 115 so as to electrically insulate this layer from the earth plane.

It is also possible for the composite substrate to be embodied by a stack of magnetic and conducting, dielectric thin layers. This stack makes it possible to modify the conditions of resonance of the conducting layer formed by the layer 111.

The magnetic material of the layers can be a ferromagnetic material used alone or coupled with an antiferromagnetic material.

For example, this composite material comprises a first stack of several ferromagnetic slender sub-layers which is superimposed on an insulating slender sub-layer itself superimposed on a second stack of several ferromagnetic slender sub-layers.

The stack of ferromagnetic slender sub-layers can be composed, for example, of a first intermediate sub-layer ensuring the interface between a first ferromagnetic sub-layer and a dielectric sub-layer, of a ferromagnetic sub-layer, of an antiferromagnetic sub-layer, of a second ferromagnetic sub-layer, and of a second intermediate sub-layer.

The first intermediate sub-layer is for example made of ruthenium (Ru), tantalum (Ta) or platinum (Pt). Its thickness can be less than 10 nm.

The first ferromagnetic sub-layer exhibits a thickness of less than the skin thickness of the ferromagnetic material and, preferably, less than a half or a third of this skin thickness. Here, its thickness is less than 100 nm and, preferably, less than 50 or 25 nm. Such a choice of the thickness of the ferromagnetic sub-layer limits the magnetic losses of the material.

Typically, this sub-layer is made of an iron and/or cobalt and/or nickel alloy. It may notably be an FeCo iron cobalt alloy or an FeCoB alloy. Here, it is an $Fe_{65}Co_{35}$ alloy.

The antiferromagnetic sub-layer is for example made of a manganese alloy and notably of a manganese and nickel alloy. For example, here, it is a nickel magnesium alloy $Ni_{50}Mn_{50}$. The presence of the antiferromagnetic layer makes it possible to create an exchange coupling so that the material is autopolarized and thus does not require the presence therefore of an artificial exterior magnetic field.

Typically, the thickness of this sub-layer is less than 100 nm and, for example, less than 50 nm.

The second ferromagnetic sub-layer is for example identical to the first ferromagnetic sub-layer. Likewise, the second intermediate sub-layer is for example identical to the first sub-layer.

The insulating sub-layer is made of a dielectric material exhibiting a relative permittivity of greater than 10 and, preferably, greater than 100 in the frequency band of interest, for example at 2 or 3 GHz. This sub-layer is typically made with the aid of an oxide of strontium (Sr) and of titanium (Ti). For example, it is strontium titanium ($SrTiO_3$). The thickness of the dielectric sub-layer is less than 10 μm or 1 μm. It is generally thicker than the ferromagnetic sub-layer and antiferromagnetic sub-layer.

The second stack is for example identical to the first stack and will not therefore be described in greater detail.

According to a variant of this embodiment, the conducting element 111 and the dielectric layer separating this element from the earth plane can be replaced with an alternation of thin layers made of high-permeability anisotropic magnetic material and of thin layers made of high-permittivity dielectric material.

The typical thickness of the thin layers advantageously lies between λ/300 and λ/100, λ being the length of the wave emitted or received by the antenna, for example, from a few tens to hundreds of nanometers.

The number of alternations can vary approximately from 1 to 10.

Figure 2:
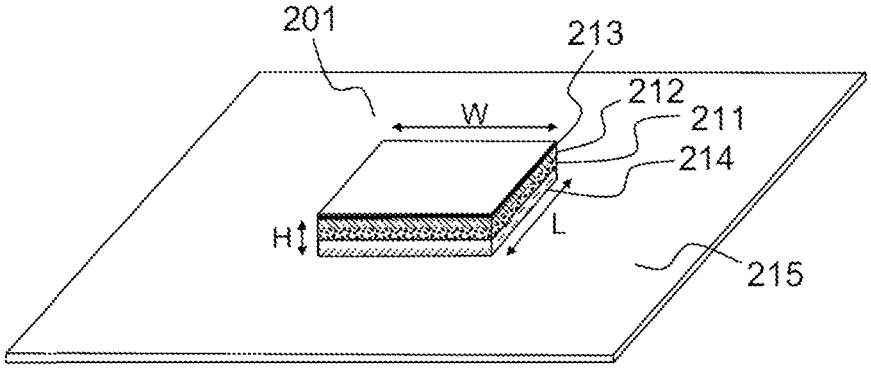
FIGS. 2 and 3 are a perspective and sectional representation respectively of a second embodiment of the antenna according to the invention.
Figure 3:
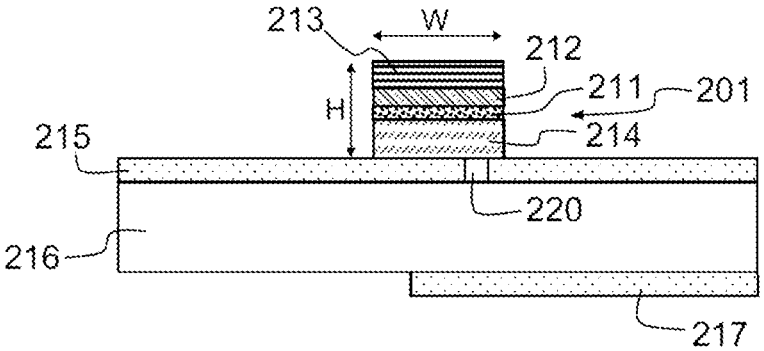

According to a second embodiment illustrated in FIGS. 2 and 3, the antenna 201 comprises a stack of two conducting elements 211 and 213 separated by an intermediate layer 212 and a dielectric layer 214 separating this stack from the earth plane 215. This conducting element contributes to more effective radiation.

The conducting element 213 on the top of the stack consists for example of gold and exhibits a horizontal front face exposed to the electromagnetic radiations. Its thickness is for example 2 μm.

The intermediate layer 212 is made of silicon dioxide and the role thereof is electrical insulation between the two conducting elements. Its thickness is equal to 1 μm in the example, but the spacing between the first conducting element 211 and the second conducting element 213 can be bigger, according to the desired level of impedance matching.

The dielectric layer 214 can comprise a substrate, for example glass.

The conducting element 211 is identical to the conducting element of the first embodiment. This conducting element can be made of conducting material of high conductivity or can be embodied by a thin-layer anisotropic magneto-dielectric composite substrate with adjustable permeability and adjustable permittivity, as will be seen further on.

The stack of this second embodiment forms, in the example, a right-angled parallelepiped of length L equal to 35 mm, of identical width W, of height H equal to 500 μm, and disposed on the metallic layer 215 forming the earth plane surmounting a substrate layer 216—in the example a substrate of aforementioned ROGERS 4003 type of thickness equal to 0.8 mm.

As will be seen further on, with these dimensions the resonant frequency of the antenna for the fundamental mode $TM_{100}$ is 2.1 GHz.

In the same manner as in the first embodiment, a microstrip transmission line 217 (FIG. 3) is placed below the substrate layer 216 (FIG. 3) to feed the antenna through a slot 220 made in the earth plane 215.

An SMA connector can be used to feed the antenna via the end of the transmission line 217.

The conducting or radiating elements are for example made of a conducting material whose conductivity is greater than 100 S/m and, preferably, greater than 1000 S/m or 1 MS/m. Here, the conductivity of the resonating elements 14 is greater than or equal to 5 MS/m.

To design an antenna with widened bandwidth, the two conducting elements are metallic, and their dimensions in the X and Y directions are unequal. The antenna is then said to exhibit a dissymmetry in its dimensions.

However, the dimensions of this antenna can remain identical (for a square antenna) and have a widened bandwidth by making the conducting element 213 from a metallic material and the conducting element 211 from an anisotropic composite substrate.

Figure 4:
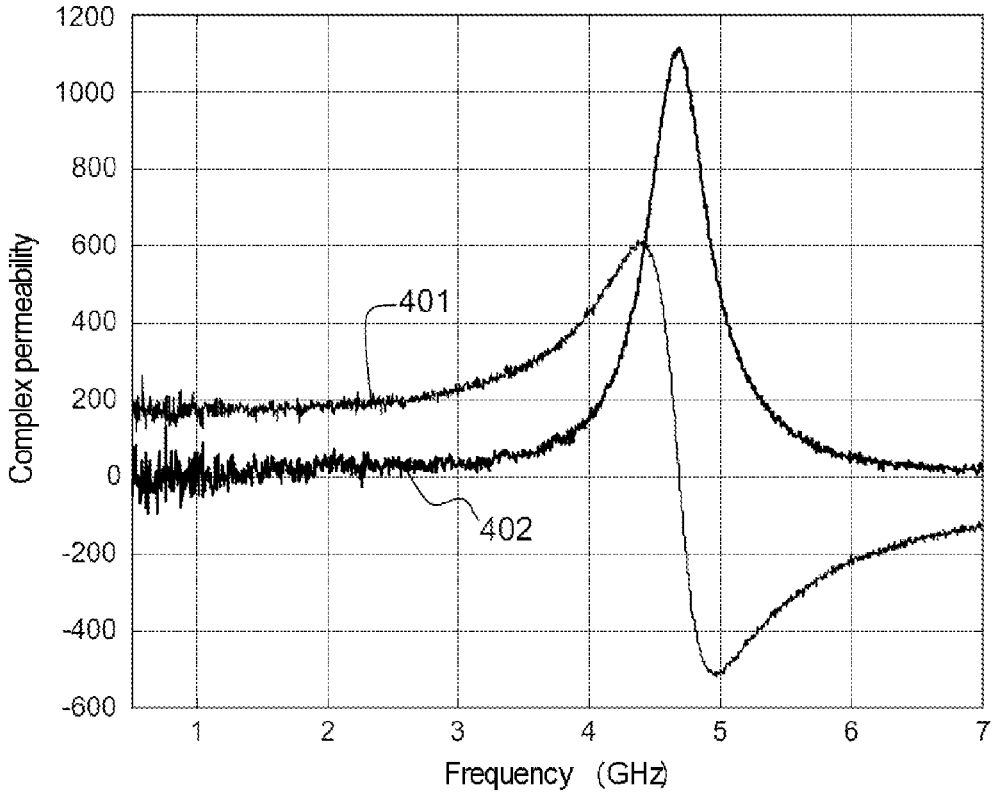
FIG. 4, curves representing the evolution as a function of frequency, the complex permeability of an anisotropic material used to form one of the conducting elements of the antenna so as to modify the conditions of resonance according to a single direction of the antenna.

FIG. 4 illustrates, by curves, the complex permeability of the anisotropic magnetic composite material as a function of the frequency of the signal feeding the antenna. The first curve 401 represents the evolution as a function of frequency of the permeability along a first axis in the plane of the antenna and the second curve 402 represents the evolution as a function of frequency of the permeability of the material along an axis orthogonal to the first axis of the curve 401, the two axes being in the plane of the conducting layer.

It is apparent that the anisotropic nature of the thin-layered material is manifested by the presence of different radioelectric properties along the aforementioned two axes, the relative permeability along the first axis being of the order of 200 at a frequency of 2 GHz, while it is close to unity along the second axis.

Consequently, the use of such a material to constitute one of the conducting layers of the antenna makes it possible to obtain two superimposed square conducting layers (layer 211 and layer 213, cf. FIG. 2 where layer 211 is the conducting element 211 which is closest to the earth plane and layer 213 is the conducting element 213 which receives the electromagnetic wave) which have equal physical lengths (two layers each of which exhibiting dimensions along the X and Y directions are equal) but have different electrical lengths, so as to widen the bandwidth. It should be noted that the conducting or radiating element 213 on the electromagnetic radiation side can have different dimensions from the conducting element 211.

Moreover, it follows from this that the anisotropic composite material satisfies the needs of compactness and of high integration of the antenna.

Figure 5A:
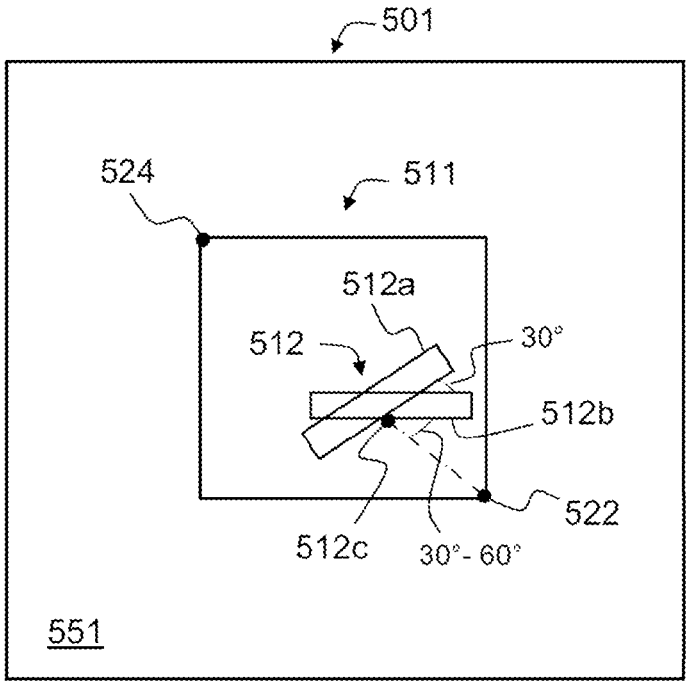
FIGS. 5*a*, 5*b*, a simplified schematic representation of examples of modes of power feed of an antenna according to the invention.
Figure 5B:
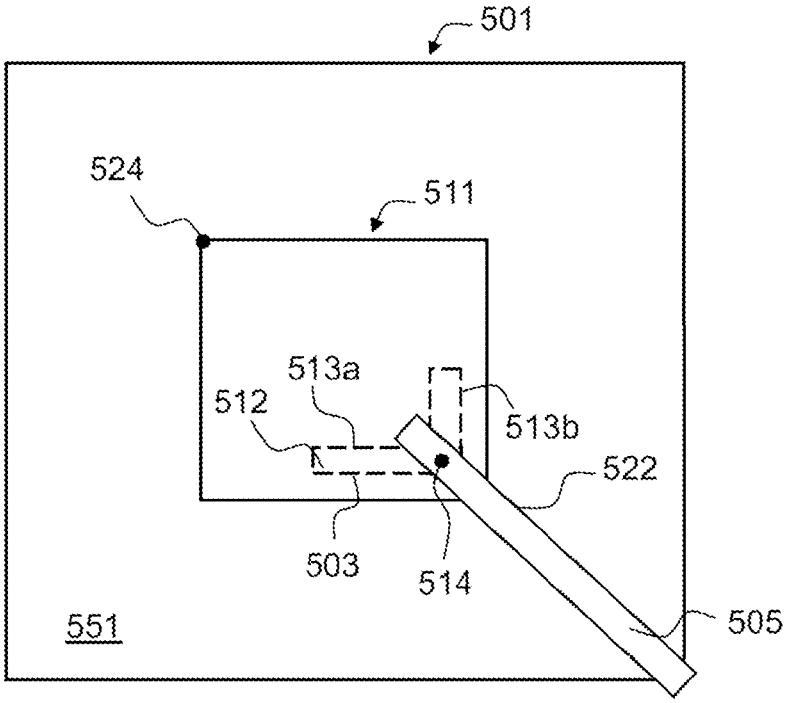

FIGS. 5*a* and 5*b* represent in a simplified schematic manner, seen from the underside, two modes of power feed of an antenna according to the invention.

To facilitate the reading of these figures, only the conducting element 111 or 211 is represented.

According to FIGS. 5*a* and 5*b*, the antenna 500 comprises a conducting element 511 in the form of a patch exhibiting four edges, only one of whose edges is referenced in these figures.

In FIG. 5*a*, a first mode of power feed by coupling is represented.

A first opening 512*a* and a second opening 512*b* of slender rectangular form are made in the earth plane 551.

The first opening 512*a* extends in a direction forming an angle of between 30° and 60° with one of the edges 520 of the conducting element 511. Advantageously, said opening 512*a* forms an angle of 45° with this edge.

The second opening 512*b* extends in a direction forming an angle of between −30° and +30° with the direction of the first opening 512*a*.

In a preferential manner, the two openings are each situated at a maximum distance, equal to a third or indeed to a quarter of the length of the electromagnetic wave, from a corner 522 of the conducting element 511. They can both be close to one and the same corner, or each close to a different corner.

The two openings 512*a* and 512*b* are situated substantially on the diagonal linking two opposite corners of the conducting element. They can be on the same diagonal and close to one and the same corner, or each close to an opposite side from the other. They can also be situated on two different diagonals linking two different opposite corners and close to one and the same edge 520 of the radiating or conducting element 511, or each disposed on these two diagonals close to two opposite edges of the conducting element 511.

The two openings can also cross and form a median point 512*c* close to a corner 522 of the conducting element 511.

In this manner, two modes of propagation of an electromagnetic field to be propagated in the antenna are forced.

The disposition of these two openings is contrary to the disposition of the openings according to the prior art in which these openings made in the earth plane are situated toward the center of the conducting element or at a distance equal to half the length of the electromagnetic wave emitted or received by the antenna, thereby giving rise to an excitation of a single propagation mode or, if they exist, of two merged propagation modes.

A transmission line 505 of microstrip type is disposed askew under the earth plane 551 to feed the conducting element 511. This line crosses each opening at an angle of between 30° and 150° with the direction in which the opening extends, the opening being chosen longer the further away from the value of 90° is the angle. This length can lie in an interval of between ⅙ to ½ of the width of the radiating element.

In FIG. 5*b*, a second preferred mode of power feed is represented.

The two openings are brought together and form an "L"-shaped slot 503 made in the earth plane 551 and placed near a corner 522 of the patch 501.

The transmission line 505 is disposed askew under the patch, at an angle of about 45° with each of the branches 513*a*,513*b* of the "L", so as to excite the antenna by coupling and cause the two separate orthogonal modes of propagation.

The transmission line 505 crosses and overhangs, by a non-negligible length, the slot 503 at the level of the angle of the "L", so as to ensure the impedance matching of the antenna. Typically, this length overhang can be greater than λ/20.

The transmission line 505 can cross the slot 503 with a different angle from 45°, but preferably in a range from 30° to 60° with one of the two branches 513*a*, 513*b*, in such a way that each of the two modes is sufficiently fed.

Thus, if the transmission line is pivoted about an axis orthogonal to the plane of the antenna and passing through a median point 514 between the exterior angle of the "L" and the interior angle of the "L", then the length of each of the branches 513*a*, 513*b* must at the same time be adapted to compensate the imbalance engendered by the angle different from 45°. For example, if the angle between one of the branches 513*a*, 513*b* and the transmission line 505 decreases, the length of this branch should be increased so as to enhance the propagation mode due to this branch.

An advantage of this second mode of power feed resides in the fact that only a single excitation inlet is needed in order to make the transmission line 505 excite the conducting element 511. This yields a power feed/excitation device that is simple to make.

In contradistinction to the invention, in order to excite two mutually different modes, the antenna of the prior art needs either two excitation ports, each of the ports allows a distinct transmission line to convey the excitation to the conducting element. The known antenna may have just a single transmission line, but in this case, two excitation inlets are necessary in order to have two modes, and a bulkier power feed circuit.

According to yet another embodiment of the antenna according to the invention, the power feed is effected by contact with a coaxial probe. The antenna can comprise a radiating element placed at the surface of a substrate surmounting an earth plane. The central core of a coaxial probe is preferably connected to a first axis of symmetry of the radiating element of the antenna (but not at its center), while the central core of a second coaxial probe is connected to a second axis of symmetry of the radiating element of the antenna (but not at its center) so as to excite two different orthogonal modes.

According to yet another mode of power feed of an antenna according to the invention, the radiating element is directly fed by contact with microstrip lines.

According to yet another mode of power feed of an antenna according to the invention, the latter is fed using a combination of different means of power feed, including the use of probes, microstrip lines, or resonant slot.

Figure 6A:
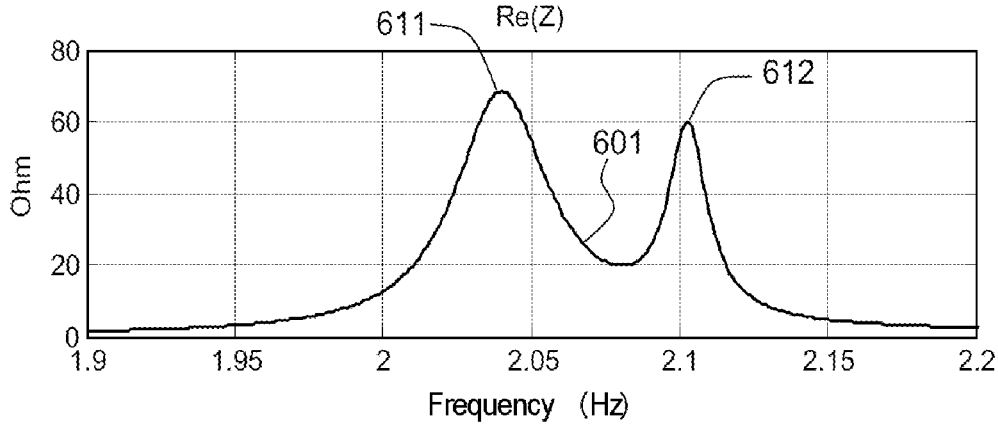
FIGS. 6*a* and 6*b*, respectively the real part and the imaginary part of the input impedance of an antenna according to the invention.
Figure 6B:
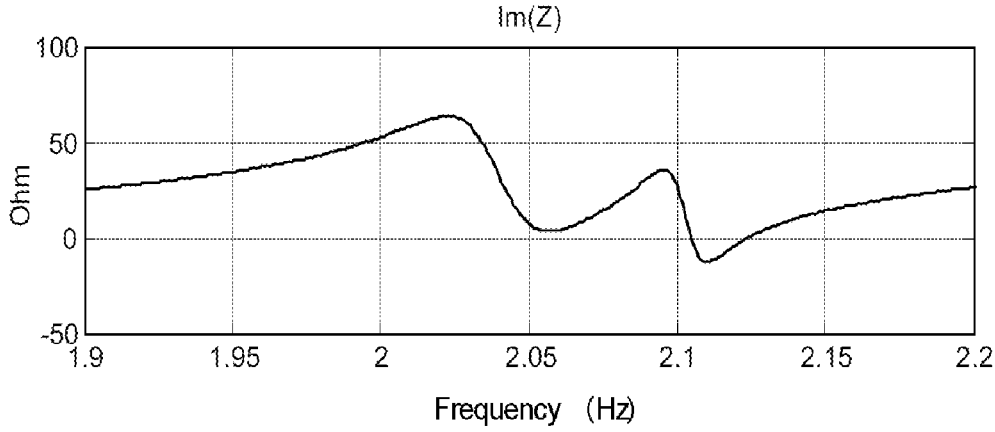

FIGS. 6*a* and 6*b*, respectively the behavior as a function of frequency of the real part and the imaginary part of the input impedance of an antenna according to the invention.

A first resonance 611 at the frequency of 2.1 GHz representing the high resonant frequency of the antenna of the invention and a second resonance 612 at a frequency of 2.04 GHz representing the low resonant frequency of this antenna are observed on the curve 601 showing the real part of the input impedance.

These two resonant frequencies, low and high, are obtained by virtue of several parameters, for example, the dimensions of the conducting elements, the shape and the position of the slot making it possible to excite two mutually orthogonal and distinct fundamental modes of propagation of the electromagnetic field propagating in the radiating elements.

Optimal operation of the antenna of the invention is obtained through the best compromise between all these parameters.

When the slot is rectangular and is situated toward the middle of the radiating elements, a single mode is excited, or several different modes can exist but are merged. Stated otherwise, the excitation of these various modes is not controlled.

The idea of the invention to design an antenna with modes of power feed of its component conducting elements, such as described in relation to FIGS. 5*a* and 5*b*, makes it possible to control the modes of propagation that are desired.

Moreover, by virtue of the dimensioning and the composition of the conducting elements, the two modes of propagation will generate two different resonant frequencies appropriately positioned with respect to one another so as to form just a single band of operating frequencies, as will be seen hereinafter.

Figure 7A:
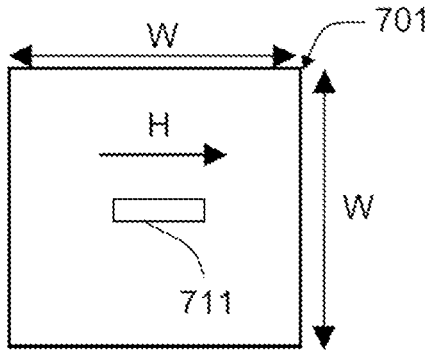
FIGS. 7*a*, 7*b* and 7*c*, simplified diagrams representing three different types of antenna, the first type of FIG. 7*a* being known from the prior art.
Figure 7B:
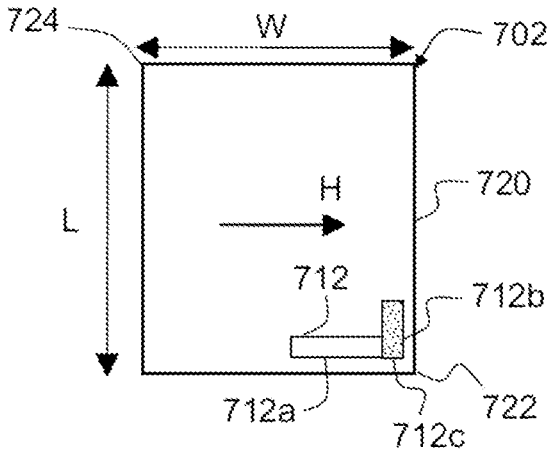
Figure 7C:
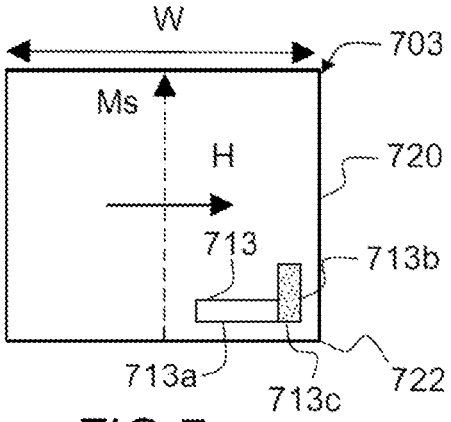

FIGS. 7*a*, 7*b* and 7*c* represent, through diagrams, three different types of planar antenna, FIGS. 7*b* and 7*c* representing simplified diagrams of an antenna according to the invention. W, H, L, Ms are the widths, lengths, heights of the conducting element and Ms one of the axes of propagation of the electromagnetic field The first type of antenna, illustrated in FIG. 7*a* and known from the prior art, comprises a conducting element 701 of square shape and a rectangular slot 711 placed substantially toward the center of this element and made in the earth plane.

The slot has a length about equal to a quarter of the central wavelength of use of the antenna, and a width equal to about a tenth of this wavelength. The transmission line feeding the antenna cuts the slot 711, so as to excite the radiating elements of the antenna. The two orthogonal modes of propagation, if they exist, are then merged, so that the bandwidth is equal to only about 1% (cf. FIG. 8).

For the second type of antenna according to the invention, illustrated in FIG. 7*b*, the conducting element has a rectangular shape and the slot is an "L"-shaped slot 712 placed near a corner 722 of the radiating element 702.

The "L"-shaped slot 712 comprises a first branch 712*a* of the "L" parallel to the length of the radiating element and a second branch 712*b* of the "L" 712*b* perpendicular to the first branch 712*a*.

The corner 712*c* of the "L" is placed near a corner 722 of the radiating element, substantially on the diagonal linking this corner 722 to the opposite corner 724 of the radiating element.

Furthermore, the first branch 712*a* is longer than the second branch 712*b*, according to a ratio substantially equal to the length ratio L/W between two adjacent sides of the radiating element. Stated otherwise, the longer the side of the antenna perpendicular to a branch of the radiating element, the larger the length of this branch is chosen to be.

Figure 8:
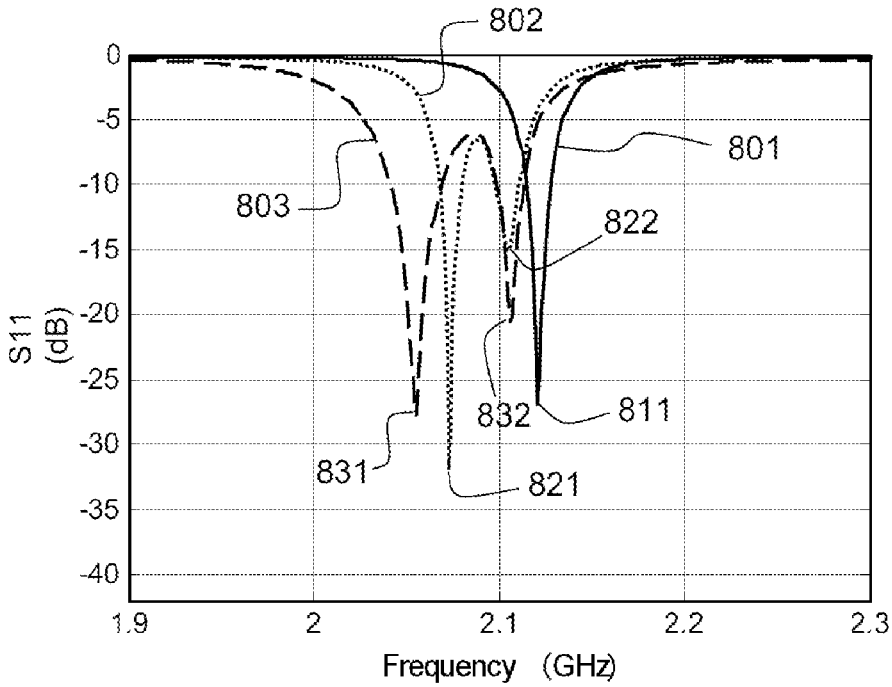
FIG. 8, curves representing the reflection coefficient as a function of frequency, for the types of antenna represented in FIGS. 7*a*, 7*b*, 7*c;*

In this example, the antenna 702 does not comprise any anisotropic material in one of its conducting layers; the radiating element's asymmetric dimensions, coupled with the unequal dimensions of the two branches of the "L"-shaped slot, makes it possible to create two separate orthogonal modes of propagation that are close in frequency, as illustrated by FIG. 8, and thus to widen the −6 dB bandwidth of the antenna, the −6 dB bandwidth of this antenna being equal to about 2.6%.

It should be noted that the point of the "L"-shaped slot which is proximal to the corner 722 of the antenna (in the example, the exterior corner 712*c* of the "L") can be brought closer to the center of the radiating element 702, without however moving away from said corner of this element by a distance of greater than a third of the length of the electromagnetic wave, lest the two orthogonal modes approach one another in frequency until they merge, thus losing the beneficial effect of the frequency separation of the two modes.

Advantageously, the median point between the exterior angle of the "L" and the interior angle of the "L", hereinafter dubbed the "midpoint" of the slot, is situated on the diagonal linking two opposite corners of the radiating element and at a distance approximately equal to a quarter of the length of the electromagnetic wave.

The third type of antenna according to the invention, illustrated in FIG. 7*c*, comprises a radiating element 703 of square shape comprising an "L"-shaped slot 713 placed near a corner of the conducting element 703. The side of this element 703 is approximately equal to half the length of the electromagnetic wave.

This conducting element 703 is embodied as substrate of an anisotropic composite material, for example the material described in relation to FIGS. 1 to 3, making it possible to modify, not the physical length of the radiating element, but the electrical length of this element in a direction in the plane of this element.

The term electrical length is understood to mean the physical length divided by the square root of the product of the effective permeability and the effective permittivity of the material.

$$l_{electrical} = \frac{l_{physical}}{\sqrt{\mu_{effective}\,\varepsilon_{effective}}}$$

The effective permeability (or permittivity) is a quantity which is such that its ratio with the specific permeability (or the permittivity) gives the relative permeability (or permittivity).

Stated otherwise, instead of modifying the physical length of the conducting element, as in FIG. 7*b*, the effective permeability of the material included in one of the radiating elements, is adjusted separately on each of the axes in the plane of the antenna.

By virtue of the use of the anisotropy properties of the material, each of the conducting elements of square shape and of like dimensions leads to a different resonant frequency, the two frequencies being brought sufficiently close together so that the bandwidth of the antenna is widened.

Hence, the dimensions of the branches 713*a*, 713*b* of the L-shaped slot, that is to say of its vertical component 713*b* and horizontal component 713*a*, are chosen as a function of the permeability of the material in each of the directions corresponding to the branches of the L, and also as a function of the dimensions of the conducting elements, that is to say their width and their length.

Likewise, the dimensions of each of the components 713*a*, 713*b* of the slot also depends on the position of the transmission line conducting the excitation signal toward the antenna, as explained above with regard to FIGS. 5*a* and 5*b*.

The −6 dB bandwidth of this antenna is equal to about 4.3%.

It should be noted that the width of the bandwidth can be adjusted via the adjustment of the spacing between the two conducting layers 211, 213 (cf. FIG. 2) of the antenna (that is to say between the two radiating elements), the choice of the dimensions of the slot or slots and of the choice of the permeability of the anisotropic material.

An advantage of the second and third type of antenna is that they each require only a single inlet to excite the radiating elements, thereby facilitating the integration of the antenna into a circuit; indeed, a single transmission line, without additional circuitry, is required.

Another advantage of these antennas is that the use of a single power feed inlet to excite two orthogonal modes of propagation of the electromagnetic field makes it possible to maintain a rectilinear polarization insofar as no phase shift is introduced between the two propagation modes.

Figure 11A:
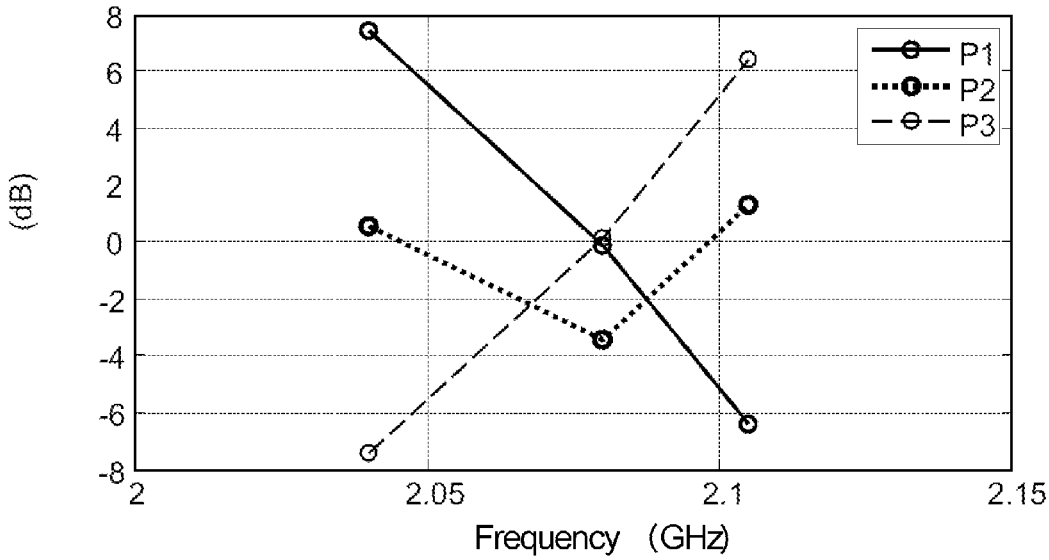
FIGS. 11*a* and 11*b*, the evolution of the axial ratio of the components of the electromagnetic field as a function of frequency.
Figure 11B:
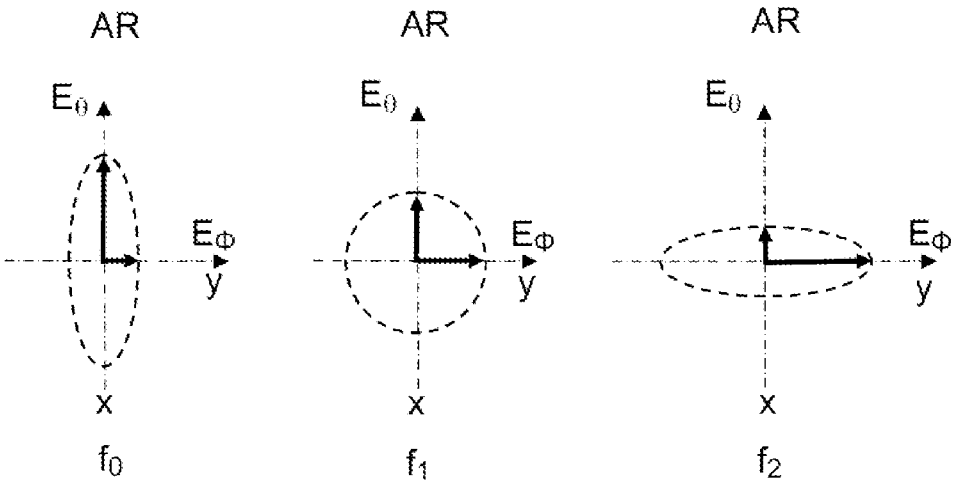

Another advantage of these antennas, which is illustrated further on in FIGS. 11*a* and 11*b*, is that the polarization of the electromagnetic field which propagates in the antenna evolves as a function of the frequency of the signal.

An advantage of the third type of antenna is that the reduction in the electrical length of one of the two conducting layers, by virtue of the permeability of the material, contributes to the miniaturization of the antenna since it is no longer necessary to increase a dimension thereof (cf. FIG. 7*b*) in order to succeed in modifying the electrical length of a radiating element.

Moreover, only a small thickness of insulation is necessary between the two conducting layers in order to remove the eddy currents, thereby making it possible to obtain an antenna of very small thickness, therefore reduced proportions.

As a corollary, the widening of the bandwidth of the antenna can advantageously be used to reduce the physical length of the antenna when a narrow band suffices for the targeted application.

FIG. 8 represents, via various curves, the reflection coefficient as a function of frequency, for the antenna types represented in FIGS. 7*a*, 7*b*, 7*c*.

A first curve 801 represents the evolution as a function of frequency of the modulus of the reflection coefficient, denoted $S_{11}$, of the first antenna type represented in FIG. 7*a*. A single negative spike 811 appears since the two modes of propagation are merged; the propagation conditions being identical on the two axes of the antenna.

A second curve 802 represents the evolution as a function of frequency of the modulus of the reflection coefficient of the second antenna type represented in FIG. 7*b*. It is noted on this second curve 802, that two negative spikes 821, 822 appear.

The appearance of the first spike 821, separated from the second spike 822, is due to the lengthening of one of the dimensions of the antenna. Each of these spikes 821, 822 corresponds to a mode of propagation of the electromagnetic wave; two orthogonal modes of propagation are therefore separated in frequency, on account of the different physical dimensions of the antenna of FIG. 7*b*.

By virtue of the appearance of these two separate orthogonal modes, the −6 dB bandwidth is markedly wider than for the first antenna of FIG. 7*a*.

It is necessary that the parameters of the antenna such as, for example, the dimensions of the slot, the dimensions of the antenna, the spacing between the two conducting layers, be chosen so that the two modes are not or too far apart in frequency, otherwise the bandwidth is split into two disjoint parts corresponding to the two spikes 821, 822.

A third curve 803 represents the evolution as a function of frequency of the modulus of the reflection coefficient of the third antenna type represented in FIG. 7*c*. As on the second curve 802, it is noted on this third curve 803, that two negative spikes 831, 832 appear.

The appearance of the first spike 831, separated from the second spike 832, is due to the use of an anisotropic magnetic material modifying the conditions of resonance in a direction of the antenna.

Two orthogonal modes of propagation are therefore separated in frequency, by virtue of the use of this anisotropic material. By virtue of the appearance of these two separate orthogonal modes, the −6 dB bandwidth for this third antenna is yet wider than for the second antenna 702 of FIG. 7*b*.

However, in this particular case, due to the position of the excitation (slot, transmission line) with respect to the conducting elements, a decrease is noted in the value of the spikes 822, 832 with respect to the value of the spike 811.

The two curves 802 and 803 exhibit a plateau approximately around a frequency close to 2 GHz and which is at −6 dB. This plateau can be lowered to values of less than −6 dB, for example to −10 dB (corresponding to the value of the bandwidth for certain communication standards), by altering the parameters such as the composition and the dimensions of the conducting or radiating elements, the mutual dispositions of the slot and of the transmission line as well as their respective geometry, and the disposition of the slot with respect to a corner of one of the radiating elements.

Figure 9:
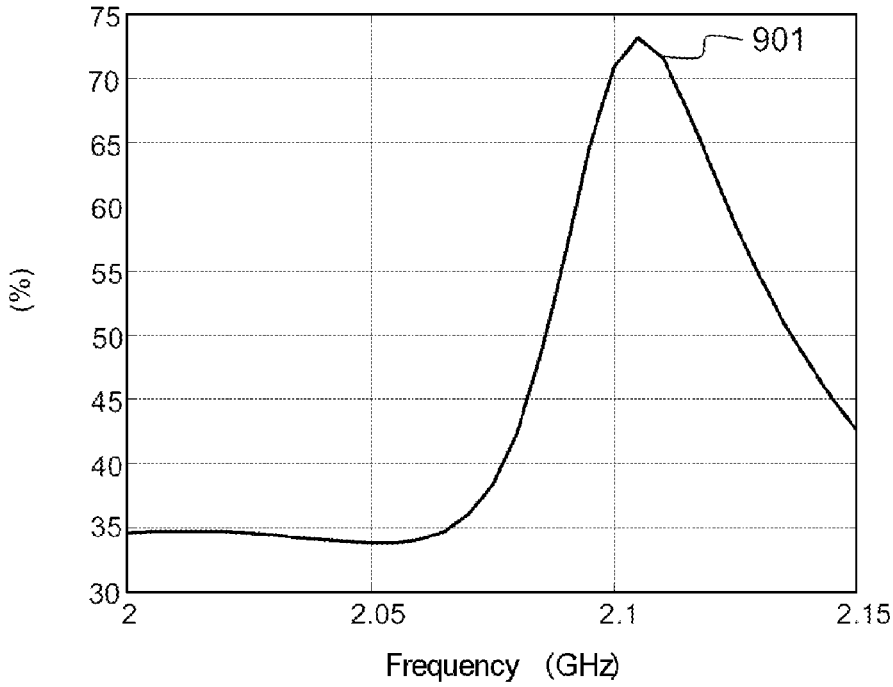
FIG. 9, a curve representing the effectiveness of radiation of the antenna of FIG. 7*c* as a function of frequency.

To evaluate the performance of the antenna according to the invention, FIG. 9 shows a curve 901 representing the effectiveness of radiation of the antenna of FIG. 7*c* as a function of the frequency of the excitation signal for this antenna. It is apparent that the antenna of FIG. 9 reveals a strong disparity as a function of frequency. The conductivity of the anisotropic material plays a significant role in the performance of the antenna, since as a function of the quality of the conducting element made from this material, a different effectiveness is obtained.

It is noted that the effectiveness is very good at the high resonant frequency which corresponds to the mode not invoked by the anisotropic material. It is however less significant on moving toward the low resonant frequency. This is due to the ohmic losses of the material which are due to the eddy currents created in the conducting layer by the variation over time of the electromagnetic field.

As declared above, one of the advantages of the invention, more particularly the antenna according to the second embodiment provided with a single excitation inlet for the transmission line, resides in the fact that the polarization of the electromagnetic field propagating in the antenna according to the invention evolves as a function of frequency and varies according to an angle ranging from 0° to 90°.

In the prior art, two excitation inlets lead to two distinct polarizations of the electromagnetic field. It is appreciated that by virtue of the invention, namely having an excitation inlet and two orthogonal modes of polarization, a rotating polarization is obtained.

To understand this phenomenon, we shall describe FIGS. 10 to 12.

Figure 10A:
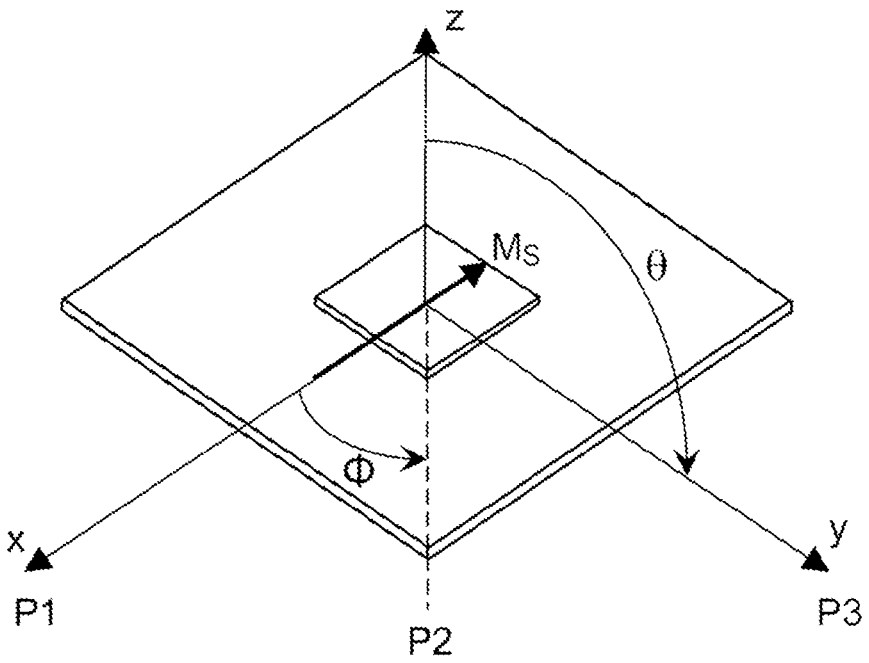
FIGS. 10*a* and 10*b*, diagrams representative of three various sectional planes and of the distribution of the electromagnetic field propagating in the antenna according to the invention.
Figure 10B:
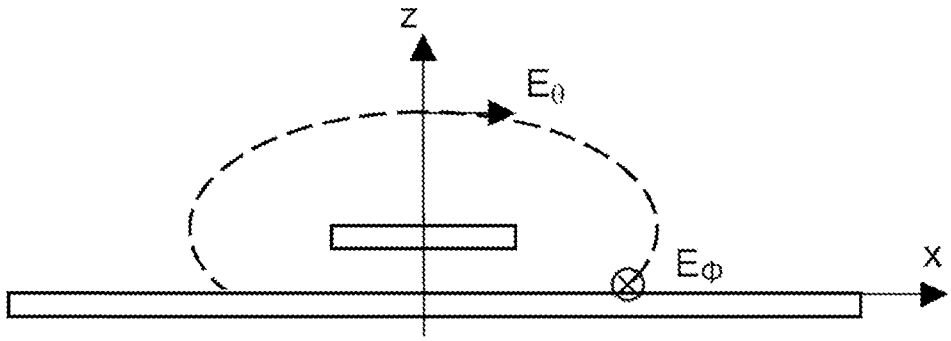

FIGS. 10*a* and 10*b* represent simplified diagrams representative of three various sectional planes of the antenna of the invention and of the distribution of the electromagnetic field propagating in this antenna.

The planes P1, P2 and P3 are defined as references to highlight the variations of the polarization as a function of frequency. They are such that the plane P1 coincides with the plane of the X direction, the plane P3 coinciding with the plane of the Y direction, the plane P2 being situated between the two.

More particularly, when the electromagnetic field is defined in known polar or cylindrical coordinates, the planes P1 and P2 define between them an angle equal to the angle $\phi$ and the plane P3 and the plane of the Z direction define an angle equal to the angle $\theta$. The plane P1 is such that $\phi=0°$, for the plane P2 $\phi=45°$ and for the plane P3, $\phi=90°$.

The electromagnetic field, more particularly the component E of this field, has two components, one $E_\phi$ along the horizontal plane comprising the angle $\phi$ and $E_\theta$ is along the vertical plane comprising the angle $\theta$.

The mode of polarization of the electromagnetic field chosen in this example is rectilinear polarization. Other polarizations can be envisaged, such as elliptical polarization or circular polarization, for example.

It should be noted that in the plane P1 is found the low resonant frequency of the antenna corresponding to the mode of propagation of the electromagnetic field propagating in the antenna provided with the anisotropic material. In the plane P3 is found the high resonant frequency of the antenna corresponding to the mode of propagation of the field propagating in the antenna without the influence of the anisotropic material (which intervenes only in a single direction). In the plane P2, the two modes of propagation of the field coexist.

In a known manner, an axial ratio is defined which is, for an elliptical polarization, the ratio between the major axis of the ellipse over the minor axis of this ellipse. If the elliptical polarization is approximated by a rectilinear polarization, this ratio equals either 0 or infinity everything depends on the axis involved.

FIGS. 11*a* to 12*b* show the evolution as a function of frequency of the axial ratio of the electromagnetic field propagating in the antenna according to the invention.

It is noted that the axial ratio for the plane P1 is low for the high resonant frequency of the antenna and then increases as the low resonant frequency of the antenna is approached.

Conversely, the ratio for the plane P3 decreases as the frequency decreases from the high resonant frequency to the low resonant frequency.

A common point exists between the two axial ratios of the planes P1 and P3 and corresponds to a point for which this ratio is zero. This point is situated between the two frequencies, where the two components $E_\theta$ and $E_\phi$ are equal. This common point corresponds to an angle $\phi=45°$.

In FIG. 11*b*, it is noted that for $f_0$, low resonant frequency $E_\theta$ is greater than $E_\phi$, so that the influence of the anisotropic nature of the material on the antenna of the invention is noted. For $f_1$ $E_\theta$ is equal to $E_\phi$, and for $f_2$, corresponding to the high resonant frequency, for which the anisotropic nature of the material is not relevant, we have $E_\theta$ less than $E_\Phi$.

Figure 12A:
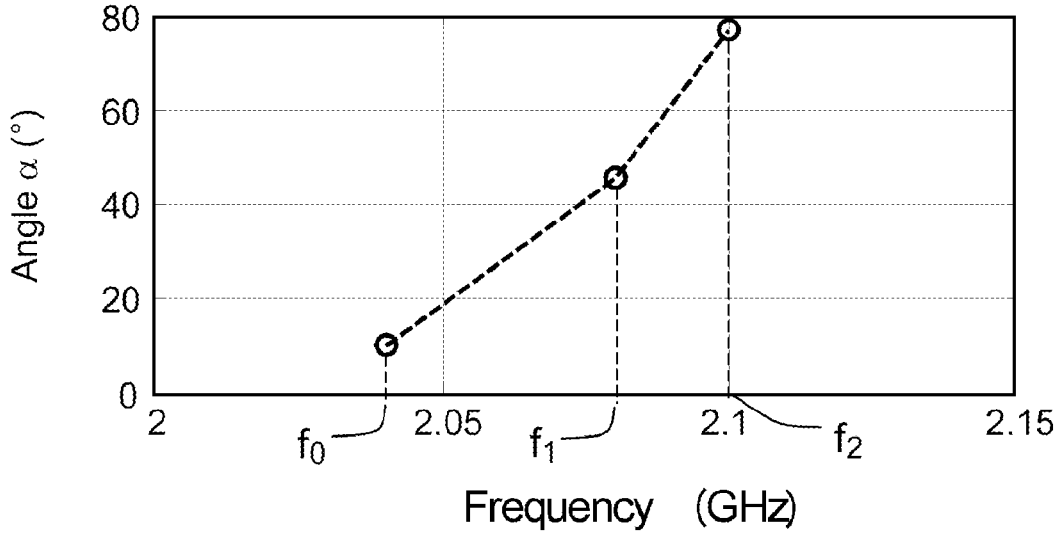
FIGS. 12*a* and 12*b*, the evolution of the angle alpha between a sectional plane and a direction of the electromagnetic field as a function of frequency FIGS. 13*a* to 13*i*, examples according to simplified diagrams of the antenna of the invention, according to the geometry of the antenna and the position of the slot (or of the openings) with respect to an edge of the antenna.
Figure 12B:
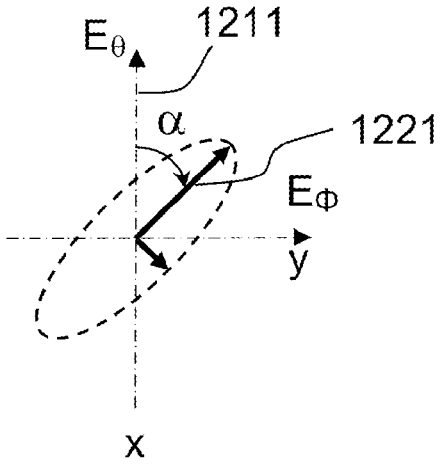

In FIGS. 12*a* and 12*b* has been represented the evolution of the angle alpha as a function of frequency. This angle alpha is defined by the angle between the plane P1 and the direction of the field E, stated otherwise along a first axis 1211 orthogonal to the direction of propagation of the field and the axis 1221 of the electromagnetic field of the signal propagated in the antenna (FIG. 12*b*).

FIG. 12*a* illustrates the evolution of the polarization of this field as a function of frequency, by showing the evolution of the angle alpha as a function of frequency. It is noted that at the low resonant frequency $f_0$ equal to 2.04 GHz, the angle alpha is equal to about 20°, then the angle alpha increases to about 45° at $f_1$=2.07 GHz and almost 90° at the high resonant frequency $f_2$=2.1 GHz.

FIGS. 13*a* to 13*i* represent variants of the embodiments of the antenna according to the invention. These variants have been in part described in relation to FIGS. 5*a*, 5*b* and 7*b* and 7*c*.

Here, either there are two distinct separate openings and two transmission lines disposed along two mutually orthogonal directions so as to excite the two orthogonal modes of propagation of the electromagnetic field propagating in the antenna, or there is a single slot with a single transmission line exciting both modes.

Figure 13:
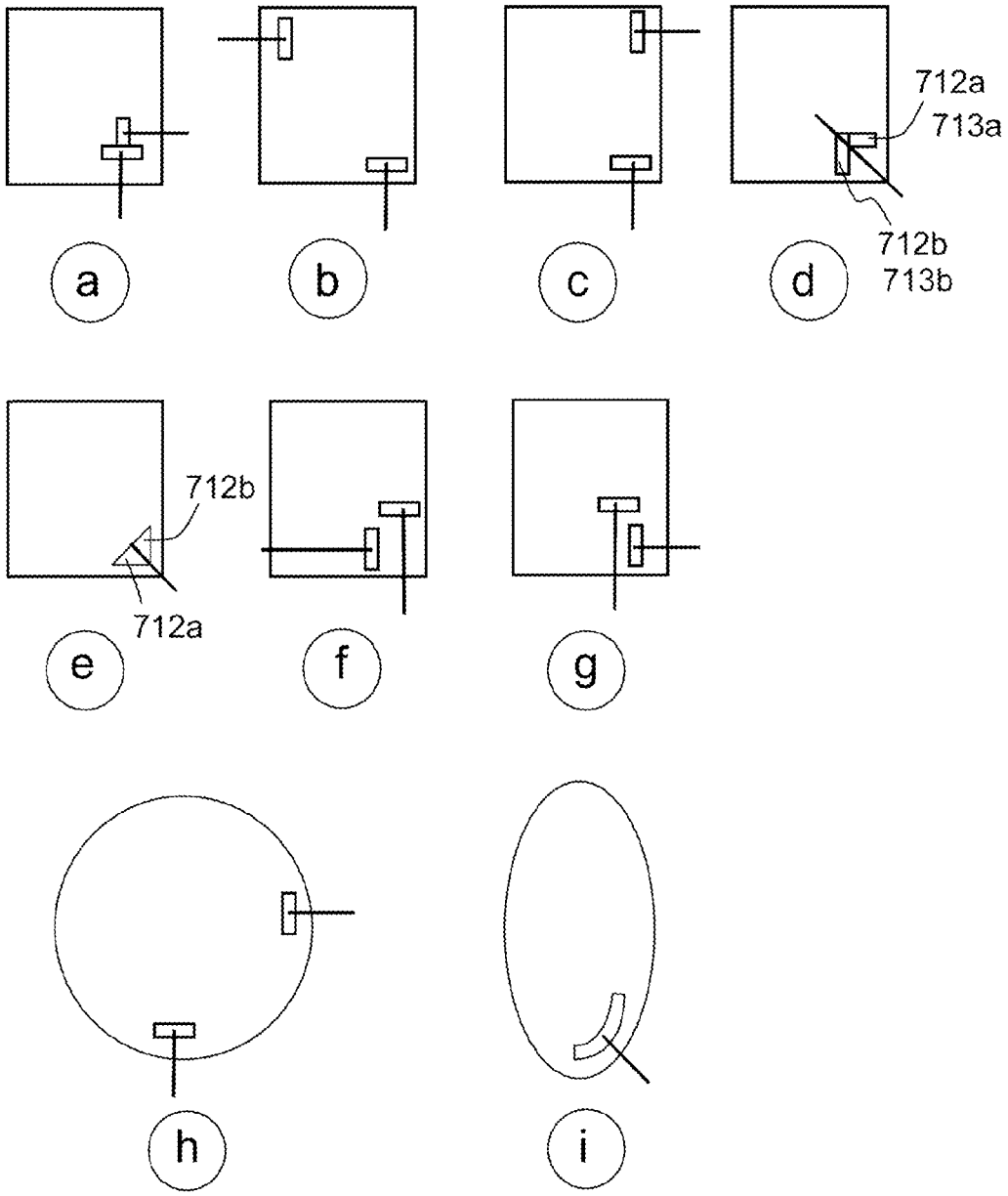

We note that the two openings can approach one another so as to produce a single "T"-shaped slot, as illustrated in FIG. 13*a*, or an "L"-shaped slot, as illustrated in FIG. 13*d*, but whose branches 712*a*, 713*a* and 712*b* and 713*b* are symmetric with respect to the branches of the slot illustrated in FIGS. 7*b* and 7*c*.

It may also be noted that it is possible to obtain a triangle-shaped slot as illustrated in FIG. 13*e*, the adjacent sides of which are in alignment with a corner of the conducting element.

It is also possible to use a radiating element of circular shape for which two openings are necessary so as to have the excitation of the two orthogonal modes of propagation, such as illustrated in FIG. 13*h*. We note, however, that the configurations of FIGS. 13*b*, 13*c*, 13*f* and 13*g* can apply for the circular radiating element.

A geometry of the radiating element in the form of an ellipse as illustrated in FIG. 13*i* makes it possible to have just a single slot for the excitation of the orthogonal modes. Indeed, here the ellipse exhibits two distinct dimensions (a major axis and a minor axis), it is therefore possible to have just a single slot in place of two openings. This slot can have any geometry, on condition that the position of the slot according to the invention is complied with. In the example of FIG. 13*i*, this slot has the shape of an arc.

Numerous other embodiments are possible.

Numerous shapes are possible for each radiating element. For example, it may be a square or orthogonal patch, in the shape of a diamond or a dipole. Generally, this shape exhibits an axis of symmetry with respect to an axis orthogonal to the plane in which the essence of this radiating element extends.

In a simplified embodiment, the second stack and the dielectric sub-layer of the radiating element 111, 211 are omitted. In a yet more simplified embodiment, the conducting or radiating element consists of a single slender sub-layer of ferromagnetic material whose thickness is less than the skin thickness of this ferromagnetic material.

As a variant, other materials may be used as dielectric. For example, it may be an oxide of barium (Ba) and of titanium (Ti), notably of barium titanium $BaTiO_3$, an oxide of hafnium (Hf), notably $HfO_2$, or of tantalum (Ta), notably $Ta_2O_5$ (ferroelectric). Nonetheless, perovskites such as $BaTiO_3$ or $SrTiO_3$ for example will be preferred, which exhibit a higher relative permittivity (of the order of 100 versus 10 for the oxides of barium or of hafnium at 2 or 3 GHz).

Other materials are also possible for the antiferromagnetic layer such as an alloy PtMn or IrMn and more generally any alloy based on manganese or else the oxides of iron or of cobalt or of nickel.

For the ferromagnetic layer, the alloys CoFeB, FeN and CoFeN will be favored, but other materials are possible, notably all the alloys associating two or three of the elements chosen from among iron, cobalt and nickel. These alloys may optionally be doped, for example with boron or nitrogen. They may also be associated with other elements such as Al, Si, Ta, Hf, Zr.

The radiating conductor 213 can be a simple wire.

Moreover, at least two antennas according to the invention can be grouped together in an array of antennas for any type of communication system so as to increase the effectiveness of the radiation as well as the gain of the antenna.

The invention claimed is:

1. A planar antenna suitable for transmitting or receiving an electromagnetic wave, said antenna comprising at least one first conducting element disposed above an earth plane and separated from the latter, and means for exciting said at least first conducting element, configured to excite two orthogonal distinct modes of propagation, wherein said at least first conducting element is embodied by a substrate comprising at least one thin layer of an anisotropic material with relative permeability of greater than 10 for 2 GHz.

2. The planar antenna as claimed in claim 1, in which the substrate comprises at least one thin layer of a dielectric material with relative permittivity of greater than 10 for 2 GHz.

3. The planar antenna as claimed in claim 1, in which the substrate comprises a stack of at least one thin layer made of anisotropic material alternating with at least one thin layer made of dielectric material, the thickness of said at least thin layers lying between $\lambda/300$ and $\lambda/100$.

4. The planar antenna as claimed in claim 1, in which said at least first conducting element exhibits equal dimensions in two orthogonal directions (X, Y), advantageously equal to half the length of the guided electromagnetic wave.

5. The planar antenna as claimed in claim 1, in which said at least one first conducting element exhibits different dimensions in two orthogonal directions (X, Y).

6. The planar antenna as claimed in claim 1, further comprising at least one second conducting element situated above said at least first conducting element and separated from the latter by an intermediate layer.

7. The planar antenna as claimed in claim 6, in which said at least one first conducting element and said at least one second conducting element have the same dimensions.

8. The planar antenna as claimed in claim 1, in which at least one slot is formed in said earth plane and configured so that at least one first conducting element is fed by electromagnetic coupling by at least one transmission line, wherein said at least one slot is embodied by a first opening extending in a direction forming an angle of between 30° and 60° with the transmission line, and by a second opening extending in a direction forming a second angle of between −30° and +30° with the direction of said first opening.

9. The planar antenna as claimed in claim 8, in which each opening comprises a proximal point at a corner of said at least one first conducting element situated substantially at a maximum distance from said corner equal to a third of the length of the electromagnetic wave, advantageously equal to a quarter of this length of the electromagnetic wave.

10. The planar antenna as claimed in claim 9, in which the proximal point is situated substantially on the diagonal linking said corner to the opposite corner of said at least one first conducting element.

11. The planar antenna as claimed in claim 8, in which said at least one transmission line crosses each opening with an angle of between 30° and 150° with the direction in which the opening extends.

12. The planar antenna as claimed in claim 8, in which the openings are brought together to form just a single slot in alignment with a corner of said at least one first conducting element, and said at least one transmission line is disposed facing this slot so as to produce an electromagnetic coupling, through the first opening and through the second opening, with said at least one first and one second conducting elements.

13. The planar antenna as claimed in claim 12, in which said single slot forms an "L" and the transmission line is disposed facing the corner of said "L" so as to form, in the plane of said at least conducting elements, an angle of between 30° and 60° with each of the two axes of the "L", advantageously forming an angle of 45° with these axes.

* * * * *